US006364447B1

(12) United States Patent
Boleda et al.

(10) Patent No.: US 6,364,447 B1
(45) Date of Patent: Apr. 2, 2002

(54) CORRECTION SYSTEM FOR DROPLET PLACEMENT ERRORS IN THE SCAN AXIS IN INKJET PRINTERS

(75) Inventors: Miguel Boleda, Barcelona (ES); Stefano Schiaffino, Menlo Park, CA (US); Albert Serra, Barcelona (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/506,736

(22) Filed: Feb. 18, 2000

(30) Foreign Application Priority Data

Feb. 18, 1999 (EP) ..... 99103185

(51) Int. Cl.[7] ..... B41J 2/01
(52) U.S. Cl. ..... 347/19; 347/37
(58) Field of Search ..... 347/19, 37, 8

(56) References Cited

U.S. PATENT DOCUMENTS 5,534,895 A 7/1996 Lindenfelser et al. ..... 347/19
5,600,350 A 2/1997 Cobbs et al. ..... 347/19
5,644,344 A * 7/1997 Haselby ..... 347/19
5,796,414 A * 8/1998 Sievert et al. ..... 347/19

* cited by examiner

*Primary Examiner*—Craig A. Hallacher

(57) ABSTRACT

A method and apparatus for correcting for drop placement errors due to relative rotation between an inkjet printhead mounted in a printer carriage and the print media to be printed on comprises first determining the relative contribution to the drop placement error due to rotation of the printhead about the scan axis (Y axis error), then, with respect to any determined Y axis error, applying the same magnitude and sense of correction for drop placement errors while printing in both a first scanning direction of the carriage and while printing in a second scanning direction of the carriage. Errors due to rotation about the Z axis are also corrected for. Preferably the errors are determined by printing and scanning a test pattern.

20 Claims, 12 Drawing Sheets

CORRECTION SYSTEM FOR DROPLET PLACEMENT ERRORS IN THE SCAN AXIS IN INKJET PRINTERS

The present invention relates to the correction of printing errors caused by printhead misalignments in inkjet printers and plotters and in particular to misalignments due to relative rotation between a printhead and the print media to be printed on.

An ink jet printer is a non-impact printing device that forms characters and other images by ejecting ink drops in a controllable way from a printhead. Ink jet printing mechanisms may be used in different devices such as printers, plotters, facsimile machines, copiers and the like. For the sake of convenience, in what follows reference will be made only to large format ink jet printers or plotters to illustrate the concepts of the present invention.

The printhead of a machine of the kind mentioned ejects ink through multiple nozzles in the form of minuscule drops which "fly" for a small space and strike a print media. Different printheads are used for different colors. Ink jet printers usually print within a range of 180 to 2400 or more dots per inch. The ink drops are dried upon the print media soon after being deposited to form the desired printed images.

There are several types of ink jet printheads including, for example, thermal printheads and piezoelectric printheads. By way of example, in a thermal ink jet printhead the ink drops are ejected from individual nozzles by localised heating. Each of the nozzles has a small heating element. An electric current is made to pass through the element to heat it. This causes a tiny volume of ink to be heated and vaporised instantaneously by the heating element. Upon being vaporised, the ink is ejected through the nozzle. An exciter circuit is connected to individual heating elements to supply the energy impulses and, in this manner, to deposit in a controlled way ink drops from associated individual nozzles. These exciter circuits respond to character generators and other imaging circuits to activate selected nozzles of the printhead in order to form the desired images on the printing support.

Thermal inkjet printing is based on accurate ballistic delivery of small ink droplets to exact locations onto the paper or other media. One key factor for sharp and high quality images stems from the accuracy of the droplet placement. Droplet placement inaccuracy results in fact in line discontinuity and roughness, as well as banding and colour inconsistencies.

Droplet placement inaccuracies are caused by imperfections and variations of the mechanical and geometrical characteristics of the printer and printhead, and the positioning of the printhead within a carriage of the printer as well as their functional performances. The defects caused by droplet placement errors appear in a variety of ways and may depend on the print modes being used (i.e. the sweep velocity of the printhead over the paper and the direction of printing).

Full colour printing and plotting requires techniques for correcting different causes of droplet placement inaccuracies. Some of these techniques, using a sensor module for measuring printing errors in appropriate printed patterns, are disclosed in EP 0 622 237.

One way to tackle this problem is to impose tight specifications on all sources of variations but for achieving a reasonable trade-off between quality and yield there is a need for correction methods for droplet placement errors.

EP 0 622 237 discloses systems for correcting some causes of droplet placement errors, in particular those which are due to printhead offsets in the scan and the media axis. These systems are currently implemented in printers/plotters as default printhead alignment procedures to be carried out in particular circumstances, i.e., change of printheads. None of these systems applies corrections for droplet placement errors caused by relative rotations between the printhead and the printing surface.

However, the trend of increasing print productivity, in particular in large format printers/plotters, by means of new printheads with more nozzles, makes those new printers more vulnerable to said errors.

According to a first aspect of the present invention there is provided a method, applicable to an inkjet printer having a scanning carriage, capable of bidirectional scanning along a scan axis, in which at least one printhead is mounted, for correcting for drop placement errors due to relative rotation between the printhead and the print media to be printed on, the method comprising the steps of: first determining the relative contribution to the drop placement error due to rotation of the printhead about the scan axis (Y axis error), then, with respect to any determined Y axis error, applying the same magnitude and sense of correction for drop placement errors while printing in both a first scanning direction of the carriage and while printing in a second scanning direction of the carriage. It is believed by the present applicants that no prior art inkjet printers correct for drop placement error due to rotation of the printhead about the scan axis.

Preferably, the method comprises printing by the printhead a test pattern on print media in which either Y errors or both Y and Z errors manifest themselves and measuring said test pattern to determined said errors.

According to a second aspect of the present invention, there is provided apparatus for correcting for drop placement errors in an inkjet printer due to relative rotations between the printhead and the print media to be printed on, comprising: a processor to store and apply correction parameters for the firing time of nozzles of said printhead wherein said stored correction parameters have been determined in accordance with the method of the present invention.

Preferably, the apparatus further comprising a test pattern generator for printing a test pattern on print media and a sensor module for obtaining measurements from said printed test pattern and the processor is capable of generating said correction parameters in dependence on the measurements made from said printed test pattern.

The droplet placement errors caused by rotations of the printhead around the carriage scan or Y axis and vertical or Z axis and translations of the printhead along the Z axis manifest themselves clearly when printing vertical lines on the print media since they appear rotated or broken into segments.

Rotations of the printhead around the Z axis cause correspondingly identical rotations of the printed vertical lines with respect to the ideal vertical direction on the paper or X axis. These errors are independent of the print direction and will be called unidirectional rotations or Z errors.

Rotations of the printhead around the Y axis cause proportional rotations of the printed vertical lines with respect to the ideal vertical direction on the paper (X axis), but these errors depend on the print direction and the carriage velocity among other factors. These errors will be called bidirectional rotations or Y errors.

Translations of the printhead along the Z axis (changes in the printhead to paper spacing), cause translations of sections of the printed vertical lines along the paper Y axis, dependant on the print direction and the carriage velocity among other factors, these will be called bidirectional translations or B errors.

All these errors occur without substantial variations along the length of the scan axis.

Although alternative techniques for determining these errors are contemplated (for example by mechanical measurements of the position of the printhead relative to the print media when the printhead is mounted in the carriage) according to preferred embodiments of the present invention, in the first step a test pattern is printed in which said errors manifest themselves.

In a second step, in said test pattern the errors of a unidirectional and bidirectional nature are measured with the sensor module. In a third step differentiated correction parameters are obtained for the errors consisting of bidirectional movements, bidirectional rotations and unidirectional rotations.

As the printer has the possibility to fire different nozzles with adjustable relative advances and/or delays, said parameters are used to modify the firing electronics. Thus a droplet which overshoots its ideal position can be ejected in advance, and a droplet which falls short of its ideal position can be fired with a delay, so as to deliver both to their exact location.

The correction method of the present invention can be included in the printhead alignment procedures incorporated into the printer/plotter to jointly correct the mentioned B, Y and Z errors. It can also be used to correct just some of the mentioned errors.

Embodiments of the present invention will now be described by way of example only and with reference to the following drawings in which:

FIG. 1 is a perspective view of a thermal inkjet large format printer/plotter 10 incorporating the teaching of the present invention.

Figure 1:
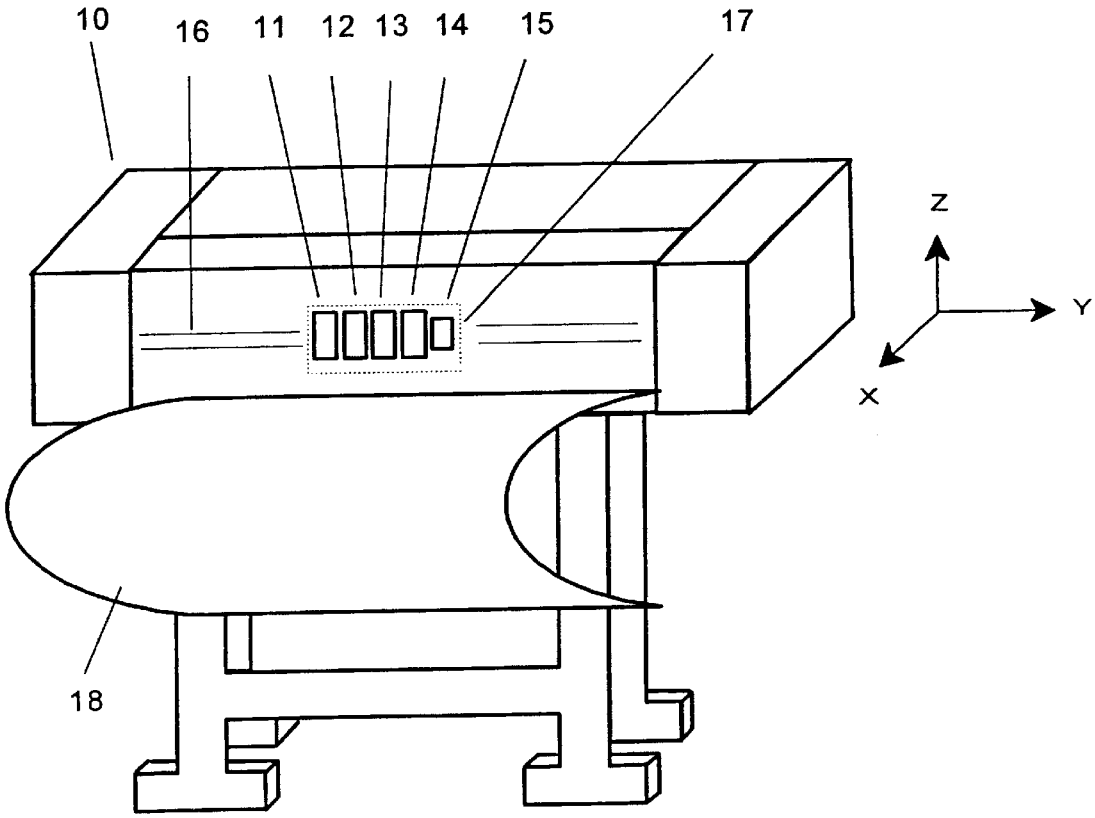
FIG. 1 is a perspective view of a thermal inkjet large format printer/plotter incorporating the teaching of the present invention.

A carriage assembly 17 is adapted for reciprocal motion along a carriage bar 16, its position in the scan axis (Y axis) being determined by known mechanisms whereas the relative position of the carriage with respect to the media is determined by another known mechanism acting on the media and causing motion thereof along the X axis (media axis).

The carriage assembly 17 has inkjet printheads 11, 12, 13, 14 that fire ink of different colors. As the carriage assembly translates relative to the media 18 along the Y axis, selected nozzles in the printheads 11, 12, 13 and 14 are activated and ink is applied to the media 18.

The carriage assembly includes a sensor module 15 and the circuitry (not shown) required for interface to the heater circuits in the printheads. The sensor module 15 is an optical device to optically sense particular printed patterns on the media 18 and provide an electrical signal indicative of the deviation of the printed pattern with respect to a given reference. An associated circuitry (not shown) converts the signal into numerical values measuring said deviation.

Figure 2:
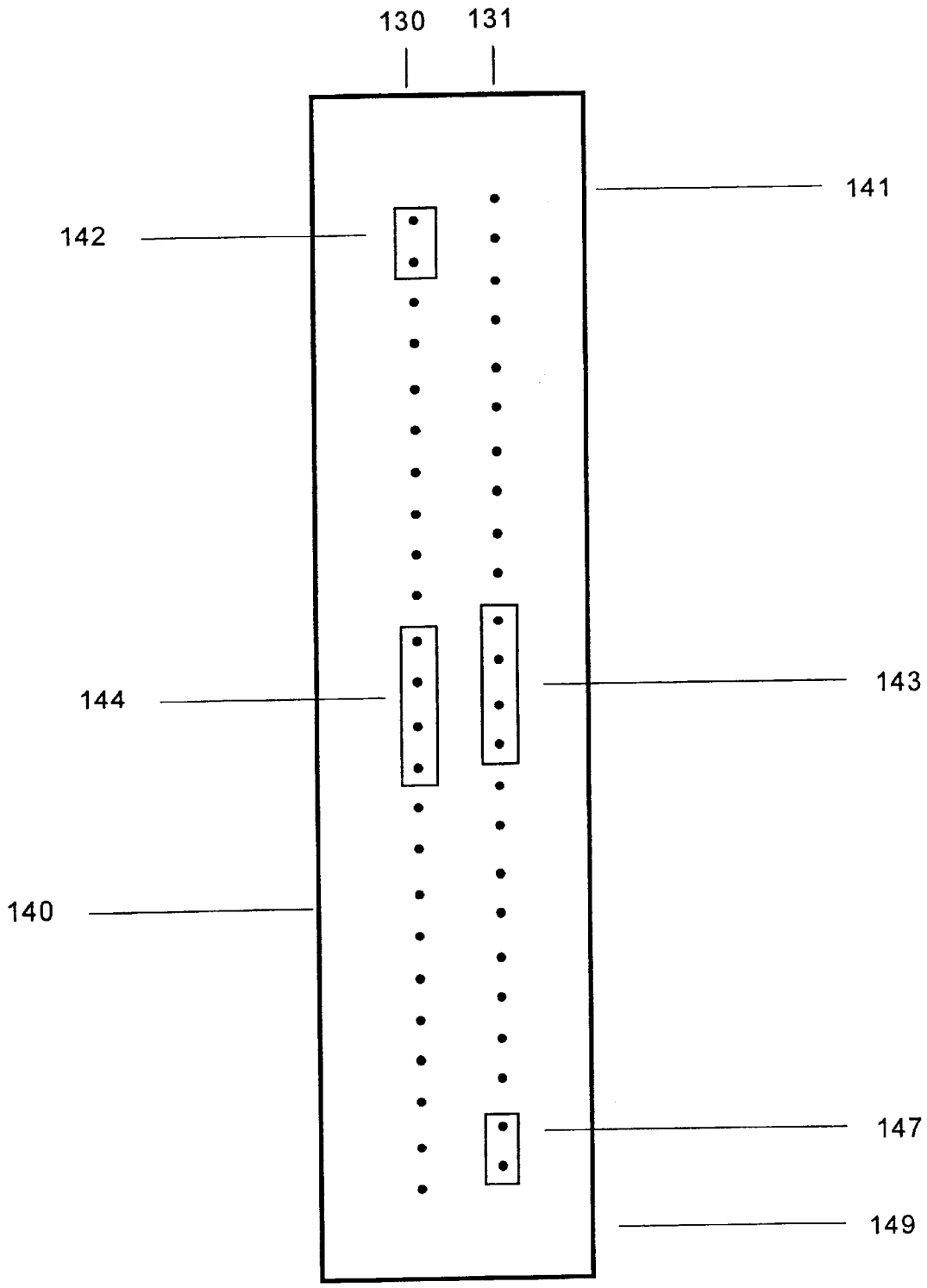
FIG. 2 is a schematic representation of a printhead.

As shown in FIG. 2, a printhead 140 has several nozzles arranged in two columns 130, 131 and grouped in primitives such as 142, 143, 144 and 147 so as to fire all the nozzles of a primitive with identical delays or advances.

The electronic firing system of the printer can apply different time advances or delays to each primitive and/or to individual nozzles.

Figure 3:
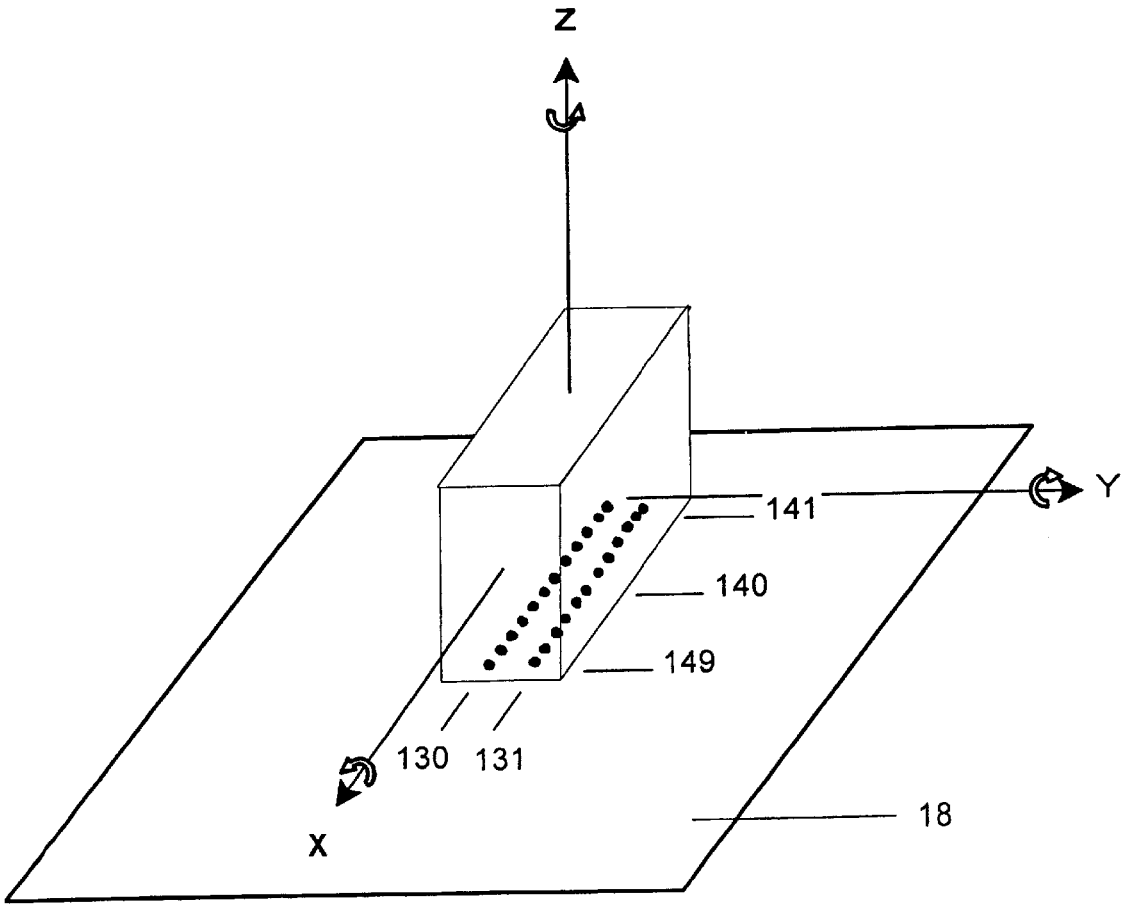
FIG. 3 is a schematic representation of an aligned printhead over a printing surface.

FIG. 3 shows schematically one of the printhead bodies in the carriage assembly 17 perfectly aligned with respect to the media 18. Its printhead 140 is located in a plane parallel to the printing plane and the columns of nozzles 130, 131 in lines parallel to the X axis. Any deviation from that position, shown for example in rotations of the printhead 140 around the Y and Z axis, will result in printing errors.

It should be understood that, when the printhead does not fire the primitives along a column at the same time, in accordance with a particular architecture, the ideal alignment of the printhead may require a little rotation around the Z axis, but for the purpose of this invention it can be assumed that the ideal printhead alignment takes place as shown in FIG. 3.

If, in turn, the nozzles of the printhead are not perfectly aligned in the way represented in FIG. 2, there will likewise be printing errors.

Figure 4:
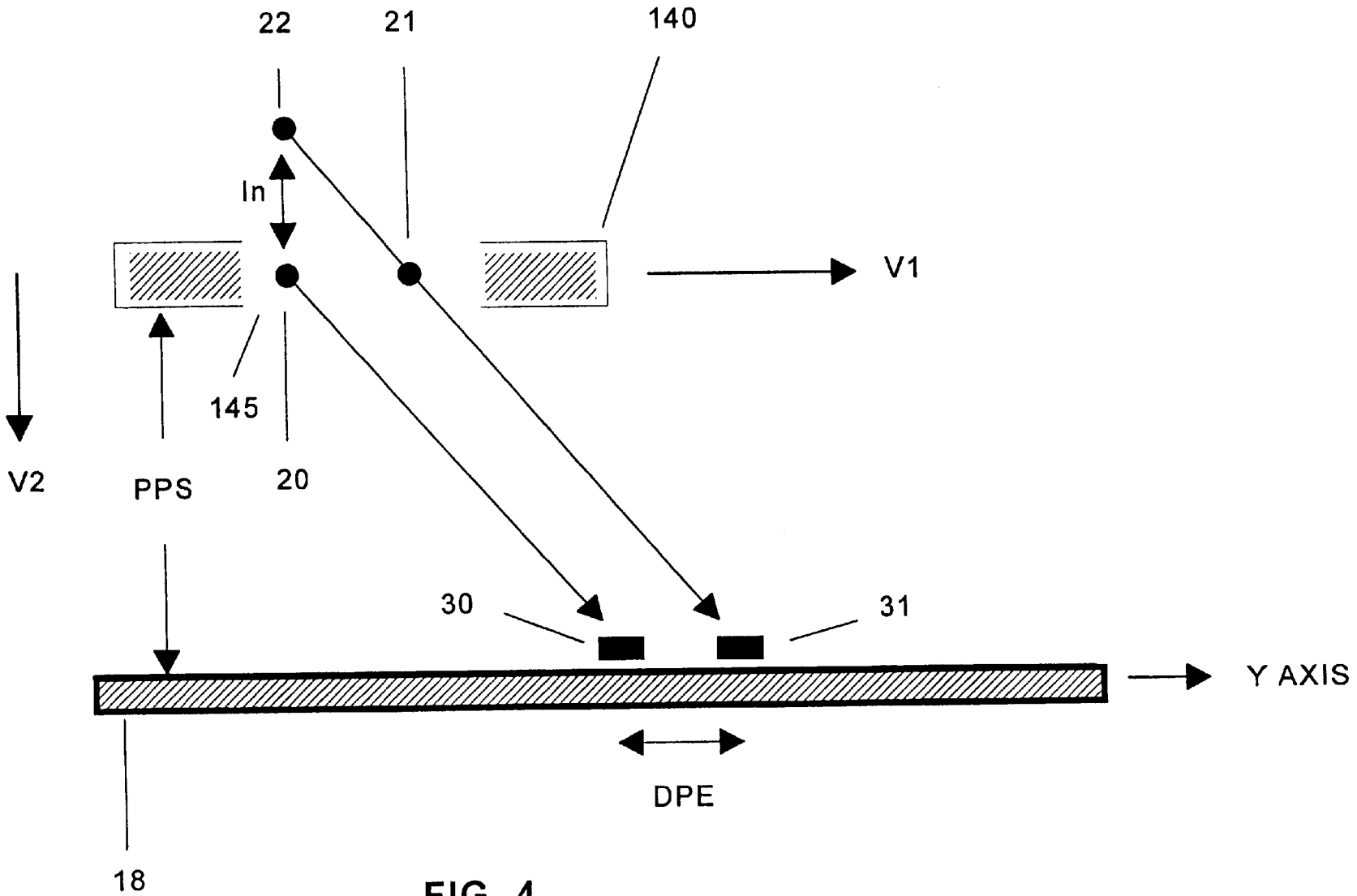
FIG. 4 is a schematic representation of dot placement errors.

In FIG. 4, which is intended to explain the dot placement error (DPE) model which will be used in the correction method subject of the present invention, a printhead 140 is represented schematically, moving in the Y axis at a speed V1.

Were such printhead perfectly aligned, the distance between the printhead 140 and the media 18 would be the desired distance PPS and the nozzle 145 would be located in its ideal position 20.

In such case, the droplet ejected by that nozzle at the speed V2 lands at the desired position 30.

Owing to any of the mentioned misalignment causes, said nozzle 145 can be located, for example, at positions 21 or 22 and then the droplet ejected by that nozzle would land at position 31, at a distance DPE from the desired position 30.

As said before, the printer/plotter subject of this invention has the possibility to fire different nozzles with adjustable relative advances and/or delays providing therefore means for the correction of printing errors.

Thus a droplet which overshoots its ideal position can be ejected in advance, and a droplet which falls short of its ideal position can be fired with a delay, so as to deliver both to their exact location.

In particular, the correction of the printing error caused by the nozzle located at positions 21 or 22 in FIG. 4 will require that this nozzle be fired some time T earlier than that programmed for its ideal position, in order for the droplet to land on the correct position 30, with T=DPE/V1.

Thus, if measurements of the printing errors are available, the advance or delay times to apply to the firing system, to correct them, can be easily obtained. The model is used to calculate the correction for all the nozzles of all the printheads, by measuring the errors of only a subgroup of them, for example only some nozzles on one printhead.

Alternatively, and particularly if printing bidirectionally with all printheads it is advantageous to measure the errors for a subgroup of nozzles on each of the printheads within the printer carriage.

Furthermore, it is useful to have a model for calculation of the printing errors, in particular those caused by a rotation of the printhead around the Y axis, to validate the corresponding correction procedures.

For this purpose it is assumed in the present invention that the droplet placement error DPE caused by nozzles unaligned in the Z axis, such being the case of the nozzle located at position 22 in FIG. 4, can be calculated by the formula:

$$DPE=V1\times In/V2$$

where V1 is the carriage speed, In the increase (or decrease) of the trajectory and V2 the drop ejection speed.

Figure 5:
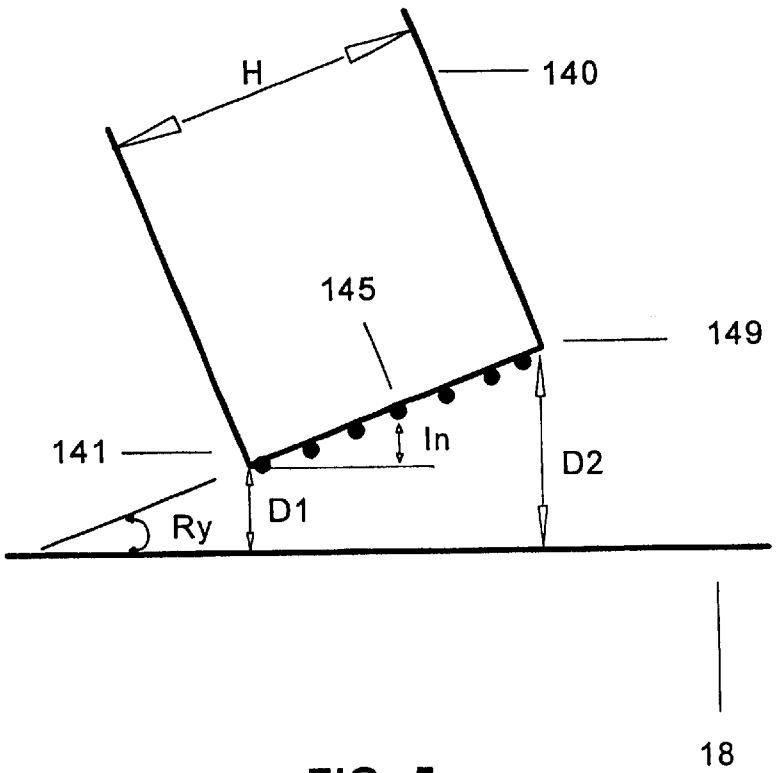
FIG. 5 is a schematic representation of a rotated printhead around the Y axis.

As clearly shown in FIG. 5, in which a section of a printhead is represented in a plane perpendicular to the axis Y with a column of nozzles from the top position 141 to the bottom position 149, a rotation around the Y axis of an angle Ry introduces uneven printhead to paper distances (PPS) across the height H of the printhead. In this figure, the top part 141 of the printhead is located at its nominal position, D1 therefore being equal to the PPS of reference, but in the bottom part 149, D2 is larger than D1, depending on the value of the angle Ry and printhead height H.

Figure 6:
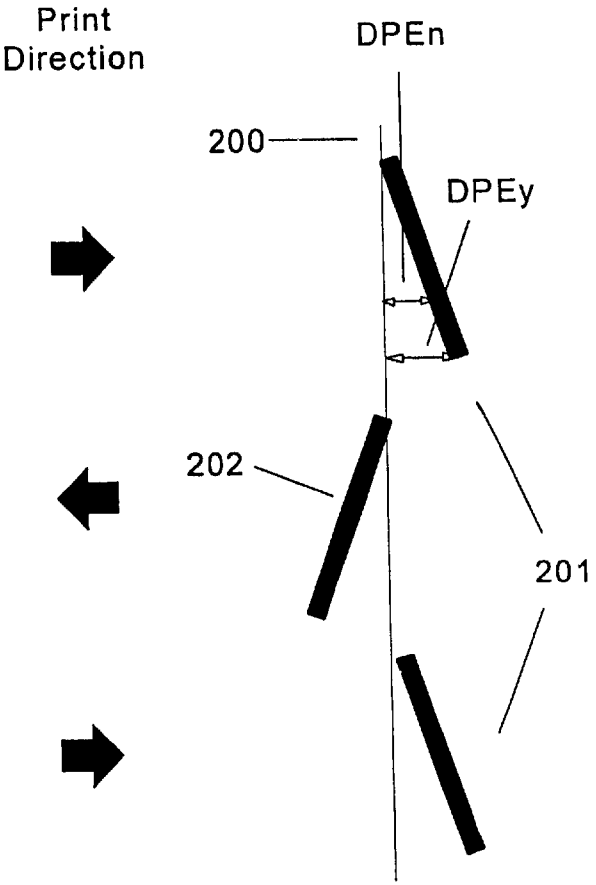
FIG. 6 shows the Y printing errors caused by a rotated printhead around the Y axis.

Printing errors caused by such rotations are shown in FIG. 6: a vertical line 200 will not be printed in vertical segments in each swath but in the segments 201 rotated towards one side when printing in the forward direction, and segments 202 rotated towards the opposite side when printing in the reverse direction. As all nozzles of the printhead have a larger PPS than expected, the droplets will overshoot their desired position on the paper.

Since the ink droplets are ejected with approximately equal speeds, the droplet flight time, i.e. the time required to travel through air and impact onto the paper, will depend as already said on the nozzle location along the printhead.

In FIGS. 5 and 6, the dot printed by nozzle 145 would have an error DPEn due to an increment of the flight time of the droplet with respect to the droplet ejected by the nozzle 141.

Obviously, these printing errors become larger for higher scan speeds and taller printheads providing wider swaths, two desirable features for improving printing productivity.

For a better understanding, the following table shows the droplet placement error between the dots printed by the top and bottom nozzles, i.e. DPEy in FIG. 6, in microns, for values of Ry between 0° and 2° and carriage speeds of 20, 25 and 40 ips., the printhead height being 21.67 mm. and the drop ejection speed 15 m/sec.

| Ry | Ry (rad) | DPE at 20 ips. | DPE at 25 ips. | DPE at 40 ips. |
|---|---|---|---|---|
| 0 | 0 | 0 | 0 | 0 |
| 0.2 | 0.00349066 | 2.56215375 | 3.20269219 | 5.12430750 |
| 0.4 | 0.00698132 | 5.12436994 | 6.40546242 | 10.24873987 |
| 0.6 | 0.01047198 | 7.68671101 | 9.60838876 | 15.37342202 |
| 0.8 | 0.01396263 | 10.24923942 | 12.81154928 | 20.49847885 |
| 1.0 | 0.01745329 | 12.81201766 | 16.01502207 | 25.62403531 |
| 1.2 | 0.02094395 | 15.37510821 | 19.21888526 | 30.75021642 |
| 1.4 | 0.02443461 | 17.93857361 | 22.42321701 | 35.87714722 |
| 1.6 | 0.02792527 | 20.50247643 | 25.62809554 | 41.00495286 |
| 1.8 | 0.03141593 | 23.06687928 | 28.83359909 | 46.13375855 |
| 2.0 | 0.03490659 | 25.63184481 | 32.03980601 | 51.26368961 |

Thus, for example, for an Ry angle of 0.6, of the printhead, and printing at 20 ips., a DPEy of 7.7 microns will be produced.

Figure 7:
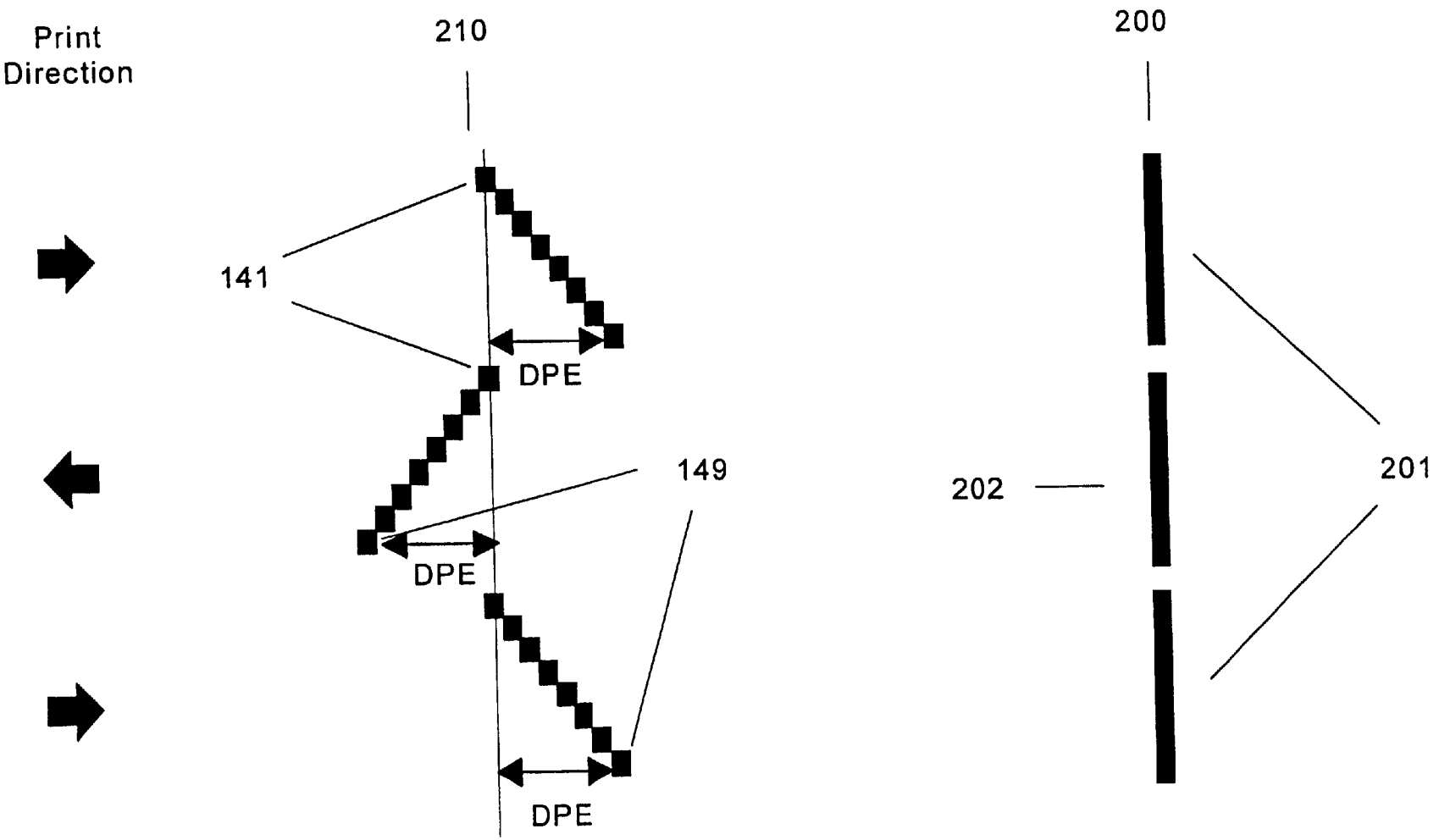
FIG. 7 is a magnified view of Y errors in vertical lines.

Although the effects in the printing of vertical lines, of a rotation of the printhead around the axis Y have already been shown earlier in FIG. 6, the same is represented anew in FIG. 7, magnifying the dots printed by different groups of nozzles. An ideal vertical line 200 to be printed in segments 201 and 202 (a blank space between them has been added for better understanding) in different swaths will be printed as line 210, in which it can be seen that the dots printed by the different nozzles are displaced from their correct position, except for the dots 141 printed by the top group of nozzles, since it is assumed that the position of the printhead corresponds with that shown in FIG. 5, in which the top group of nozzles is at the distance D1 from the printing media 18, this D1 being precisely the nominal distance PPS. The maximum displacement DPE is produced in the dots 149 printed by the bottom group of nozzles and has a different direction according to the print direction. In the forward direction, the dots displace to the right of the nominal position and in the reverse direction they do so to the left. Thus relative to the printing direction the sense of the Y errors is the same i.e. dot 149 is always printed later than intended on the media due to the greater height of it's associated nozzle from the media. The magnitude of the displacement depends on the printing speed. For convenience, these errors will here be called Y errors or bidirectional rotation errors.

Figures 8, 9, 10:
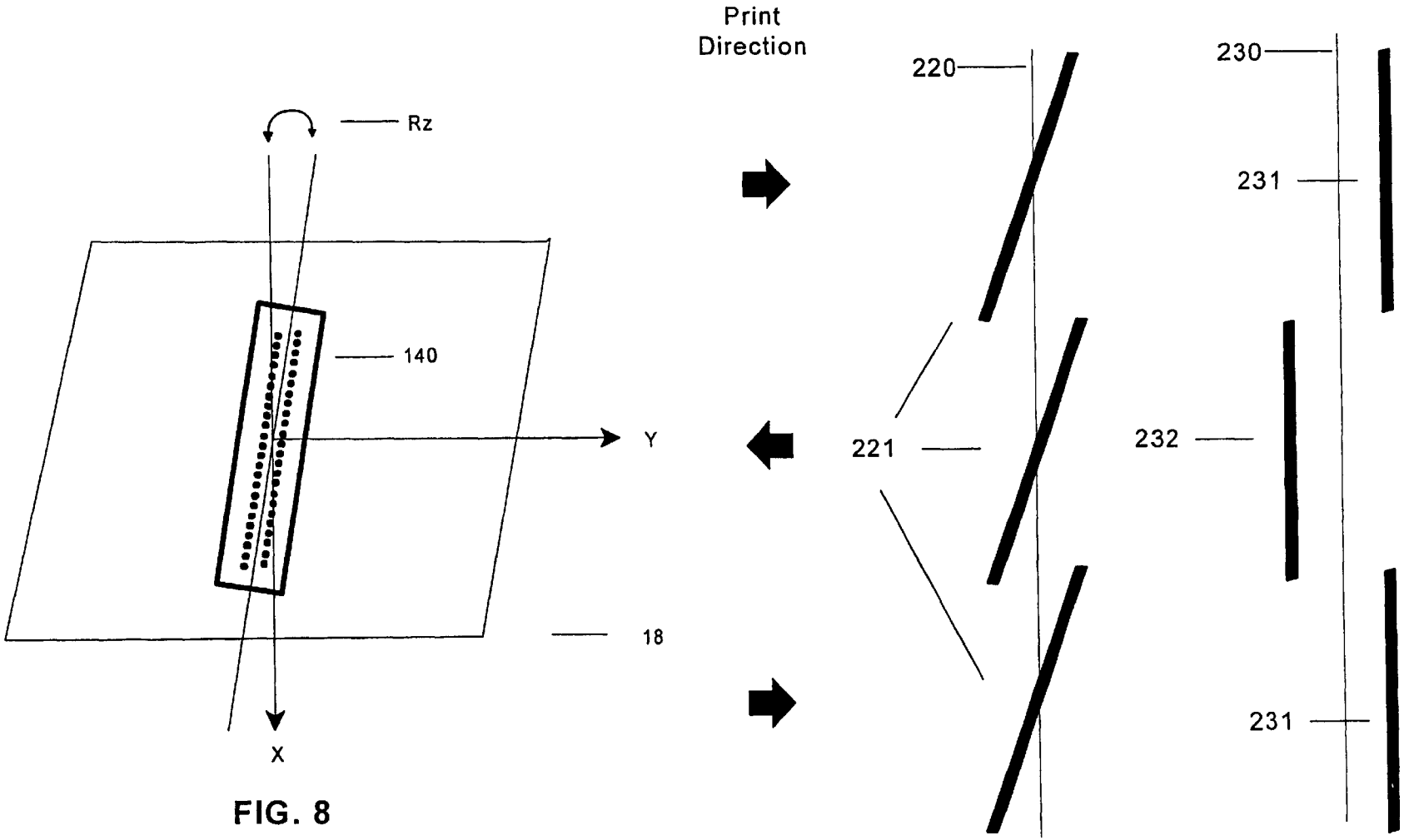
FIG. 8 is a schematic representation of a rotated printhead around the Z axis.
FIG. 9 shows the Z printing errors caused by a rotated printhead around the Z axis.
FIG. 10 shows B printing errors manifested in translations of vertical segments.

A rotation of the printhead around the Z axis would likewise cause the vertical lines to be printed in segments rotated with respect to the vertical. In FIG. 8 a printhead is represented rotated an angle Rz in the plane XY and as a result thereof, as represented in FIG. 9, a vertical straight line 220 will be printed in segments 221. In contrast to the Y errors, the direction of displacement of the printed dots on the media from their intended location for Z errors does not vary according to the print direction and their magnitude does not depend on the printing speed, since the distance from the nozzles to the printing media is the same for all of them. For convenience, errors of this type are here called Z errors or unidirectional rotation errors.

It should be noted that relative to the printing direction the sense of these Z errors is reversed i.e. a dot which is printed later than intended in one direction is printed earlier than intended in other direction.

In FIG. 10 another possible printing error is represented manifested in the printing of a vertical line 230 in segments 231 displaced to the right in the printing in the forward direction and in segments 232 displaced to the left in the printing in the reverse direction. Errors of this type can be caused by a translation of the printhead along the Z axis away from the nominal printhead to paper spacing.

B errors, like Y errors, have a different direction, depending on the printing direction and their amount depends on the printing speed.

Figure 11:
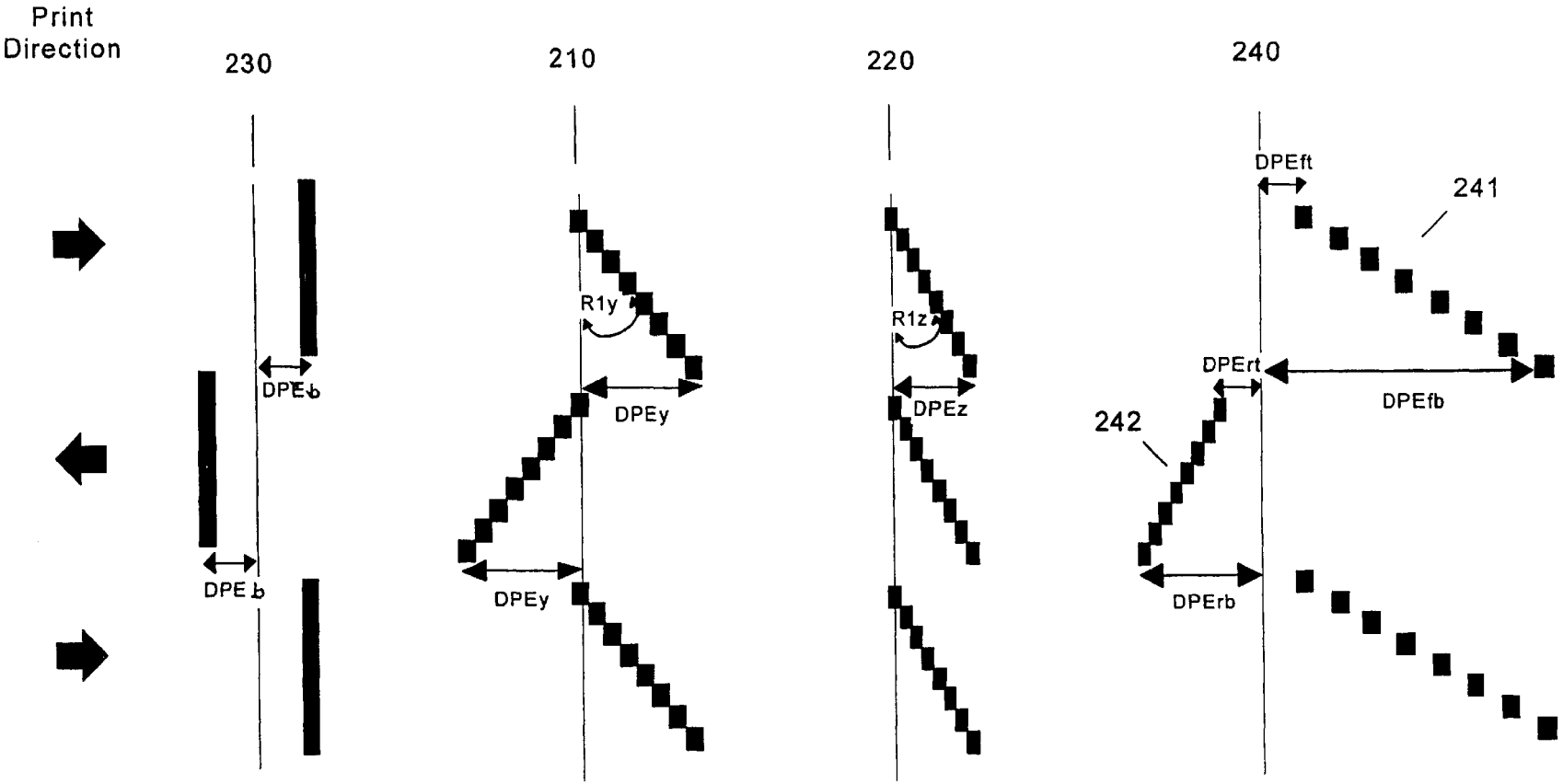
FIG. 11 is a magnified view of B, Y and Z errors in vertical lines.

FIG. 11 shows the superimposition of the three types of error referred to, in the printing of a vertical line 240, line 230 representing the B error contribution, line 210 representing the Y error contribution and line 220 representing the Z error contribution.

As can be seen, in the line 240 segments 241 printed in the forward direction are rotated in a R1z+R1y angle while segments 242 printed in the reverse direction are rotated in a R1z−R1y angle, with R1z=Rz and R1z=f(Ry, V1).

The contribution of the B, Y and Z errors in the final errors of the dots printed by the top and bottom group of nozzles can be expressed as follows:

DPEft=DPEb

DPErt=−DPEb

DPEfb=DPEb+DPEz+DPEy

DPErb=−DPEb+DPEz−DPEy

The origin of the coordinate system used is located on the thin vertical line shown in the figures from which all distances will be measured. Hence, magnitudes such as DPErt in FIG. 14A will be negative.

We shall now describe the method of correction of printing errors in the scan axis according to embodiments the present invention.

In a first step, the printer is programmed to print blocks with the top and bottom groups of nozzles of the black printhead in the forward and reverse direction in the same lines, at a given speed, as a test pattern suitable for manifesting such errors.

Figure 12:
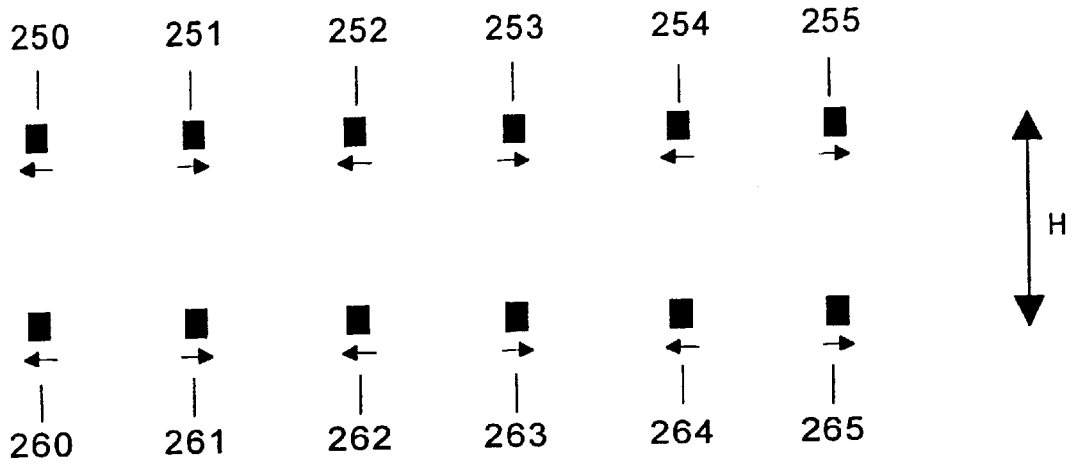
FIGS. 12, 13 and 14 illustrate the test patterns used for measuring Y, Z and B errors.

FIG. 12 shows said test pattern in the absence of said errors. Blocks 251, 253 and 255 are printed in the forward direction and blocks 250, 252 and 254 are printed in the reverse direction with the top group of nozzles. Blocks 261, 263 and 265 are printed in the forward direction and blocks 260, 262 and 264 are printed in the reverse direction with the bottom group of nozzles. All blocks are equally spaced.

Figure 13:
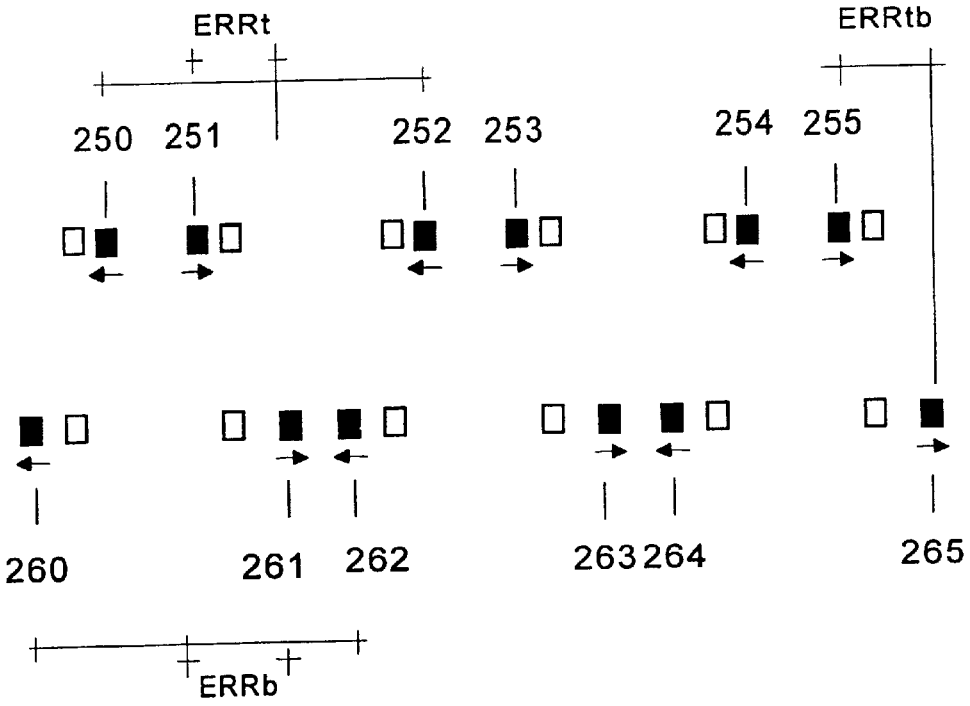

FIG. 13 shows said pattern when errors are present. All blocks are misplaced from their nominal position, which is represented by blank blocks.

In a second step, with the sensor module the error measurements ERRb, ERRt and ERRtb are obtained, represented in FIG. 13.

ERRb measures the distance between the centroid of block 261, printed in the forward direction and the middle point between the centroids of contiguous blocks 260 and 262, printed in the reverse direction. ERRt provides a similar measure for the top group of nozzles.

ERRtb is the distance between the centroids of blocks 255 and 265 printed in the forward direction with the top and bottom group of nozzles, respectively.

The mentioned measurements are obtained throughout the entire test pattern and are temporarily stored in a RAM memory.

In a third step, a set of parameters is calculated to correct the printing errors throughout the scan axis, differentiating the contributions by the B, Y and Z errors which may be stored in a non-volatile memory associated to the electronic firing system of the printer/plotter.

Figure 14B:
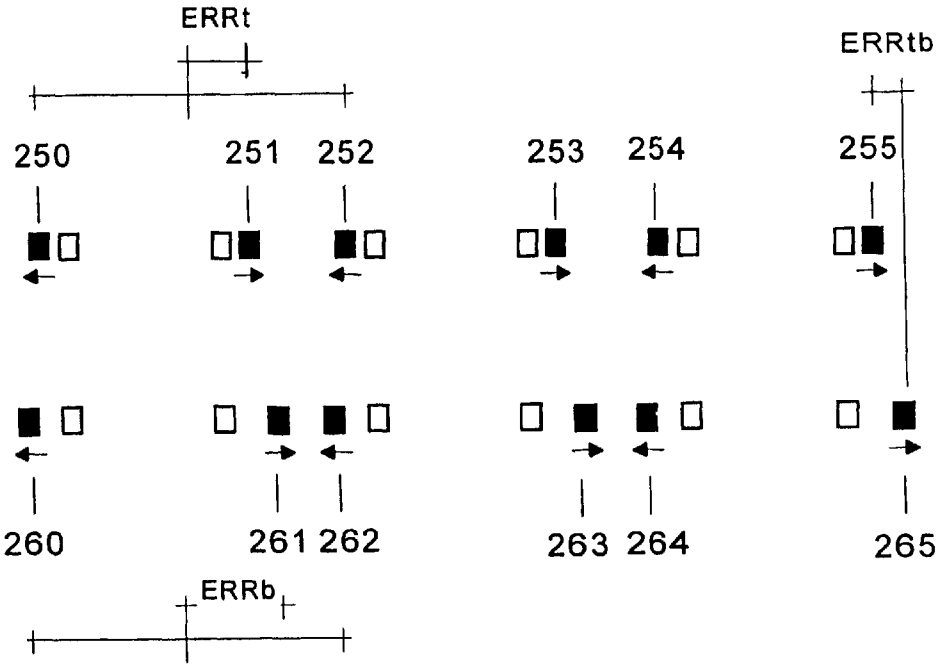
Figure 14A:
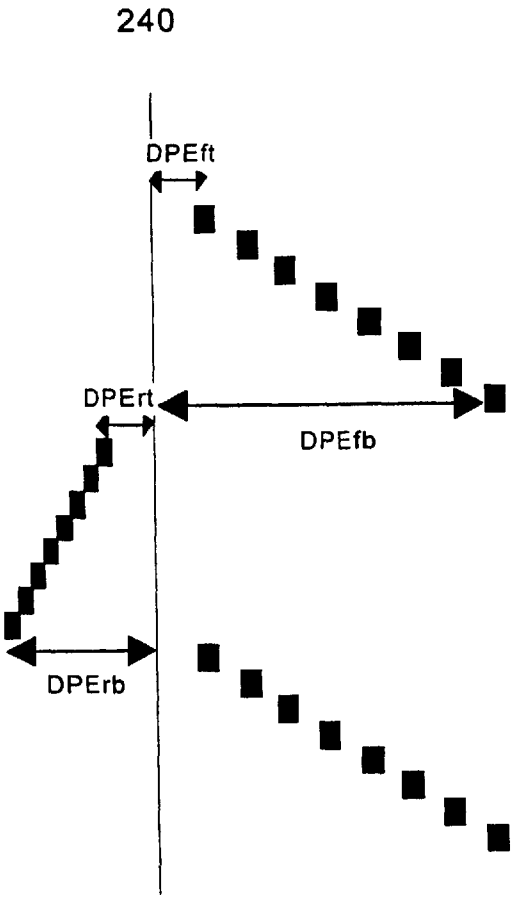

We shall explain the fundamental elements of the mentioned calculation in reference to FIG. 14B which shows the test pattern that will be printed with the unaligned printhead that would print line 235 of FIG. 11, which is repeated as FIG. 14A.

Starting from the ERRb, ERRt and ERRtb measurements, the values DPEb, DPEy and DPEz are obtained, which respectively identify the contributions by the B, Y and Z errors.

From the example represented in FIGS. 14A and 14B, it is readily gathered that the errors measured in the test pattern can be expressed through the following formulae:

ERRb=DPEfb−DPErb

ERRt=DPEft−DPErt

ERRtb=DPEfb−DPEft

Substituting in these formulae DPErb, DPEft and DPErt according to their expressions in terms of DPEb, DPEy and DPEz, as indicated earlier, it turns out that:

DPEb=ERRt/2

DPEy=(ERRb−ERRt)/2

DPEZ=ERRtb−(ERRb−ERRt)/2

From the values DPEb, DPEy and DPEz, the time correction parameters, i.e., the advances or delays to apply to the firing electronics, are calculated in line with the model explained above.

The correction in the forward direction is thus given by

DPEfb=DPEz−DPEy−DPEb and the correction in the reverse direction is given by $$DPErb = DPEz + DPEy + DPEb - 2DPEy - 2DPEb$$

$$= DPEz - DPEy - DPEb$$

as stated earlier.

As indicated earlier, in the Y and Z errors, the different groups of nozzles along the printhead produce errors of different sizes. In this respect, the time correction parameters for each group of nozzles are obtained by means of a linear interpolation of the values of the top and bottom group of nozzles corresponding to the DPEY and DPEZ values, which, in the examples we have been considering, reflect the error produced by the bottom group of nozzles (the top group of nozzles does not produce Y and Z errors).

In the case of the B errors, all of the groups of nozzles will have the same correction parameter.

The correction parameters calculated according to the method we have just explained would be applicable directly for the same printing speed used in printing the test pattern. However, the method also includes its calculation, in the case of the B and Y errors, for different speeds using the model mentioned above.

Figure 16:
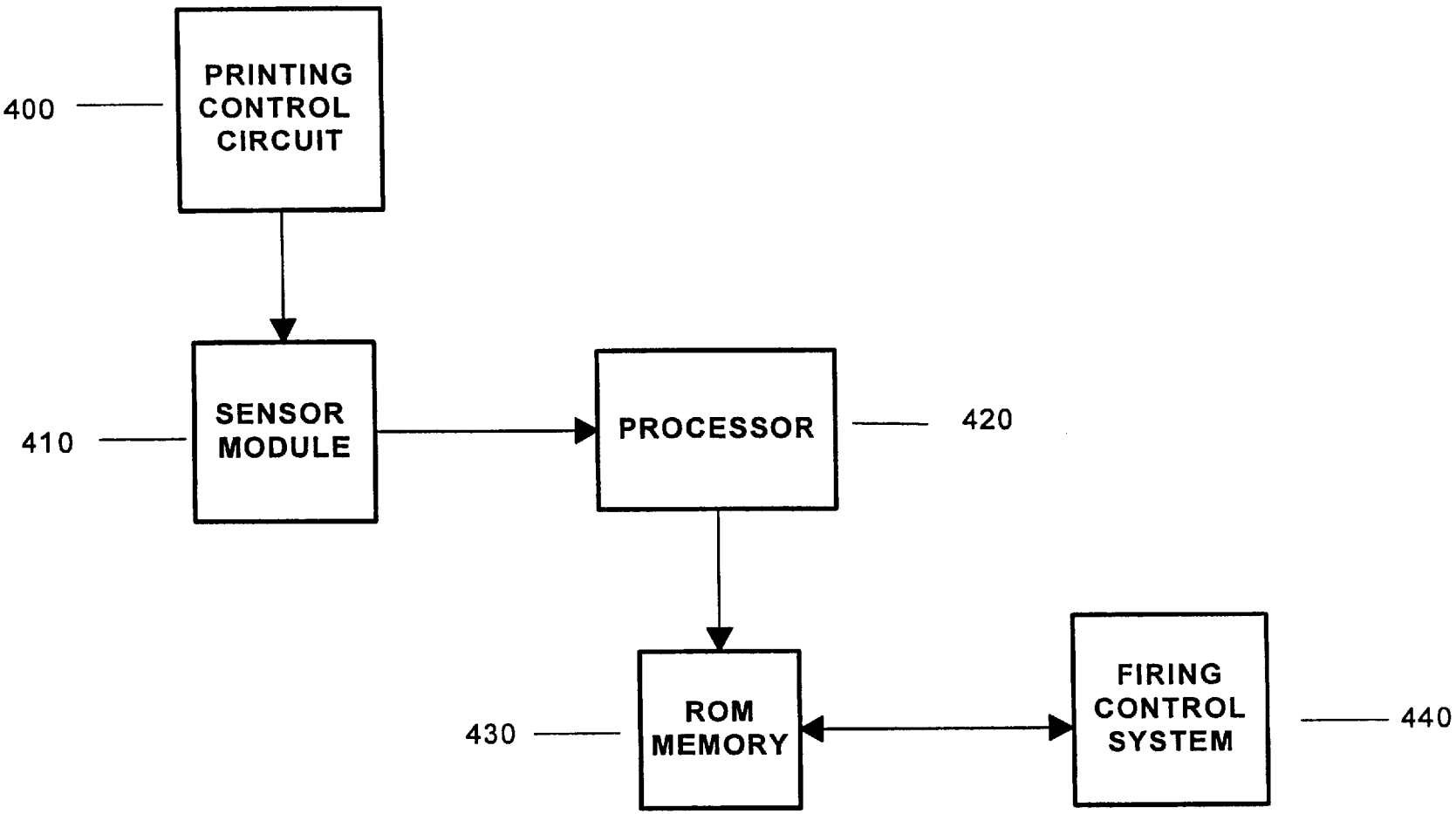
FIG. 16 is a block diagram of the electronics for implementing a printhead alignment procedure incorporating the correction system of the present invention.

The electronics for implementing printhead alignment procedures including the correction of errors according to the present invention is schematically shown in the block diagram of FIG. 16.

The circuit 400 allows the printing of the desired test patterns to be measured with the sensor module circuitry 310.

Processor 420 is programmed to make the above-mentioned calculations and to store the correction parameters in memory 430 where they are available for electronic firing circuits 440.

On the basis of the description provided so far, it will be readily understood that the method subject of the present invention allows alternative embodiments.

In the first place, instead of printing the test pattern with the top and bottom group of nozzles and obtaining the correction parameters for these groups, other groups could be used, provided they are sufficiently separated to allow the correction parameters to be obtained for all the nozzles by linear interpolation of the correction parameters calculated for them.

In the second place, other test patterns could be used provided they adequately show the mentioned B, Y and Z errors and other forms of measuring the errors of the test pattern, as long as they allow differentiating the contributions by the mentioned B, Y and Z errors.

In the third place, the method may be applied to a printer during manufacture of the printer and the correction parameters stored within the printer for use during printing. Although this means that the printer may not be able to recalculate the correction parameters, it does result in a cheaper printer since the test pattern printing and sensing apparatus are not required.

As known in the art, the thermal printer/plotters of the type subject of the present invention incorporate printhead alignment procedures that can be performed by users or automatically by the printer when certain circumstances occur which may cause printing errors, such as, for example, when the printheads are changed. Generally these procedures carry out different types of correction sequentially, for example the procedures may correct for misalignments of one printhead relative to the other and for misdirected nozzles or nozzle columns and other errors that are not due to the errors corrected for by the present invention.

It will thus be appreciated that the method of the present invention may be included in printhead alignment procedures incorporated into the printer/plotter to jointly correct for the mentioned B, Y and Z errors in addition to other errors.

Figure 15:
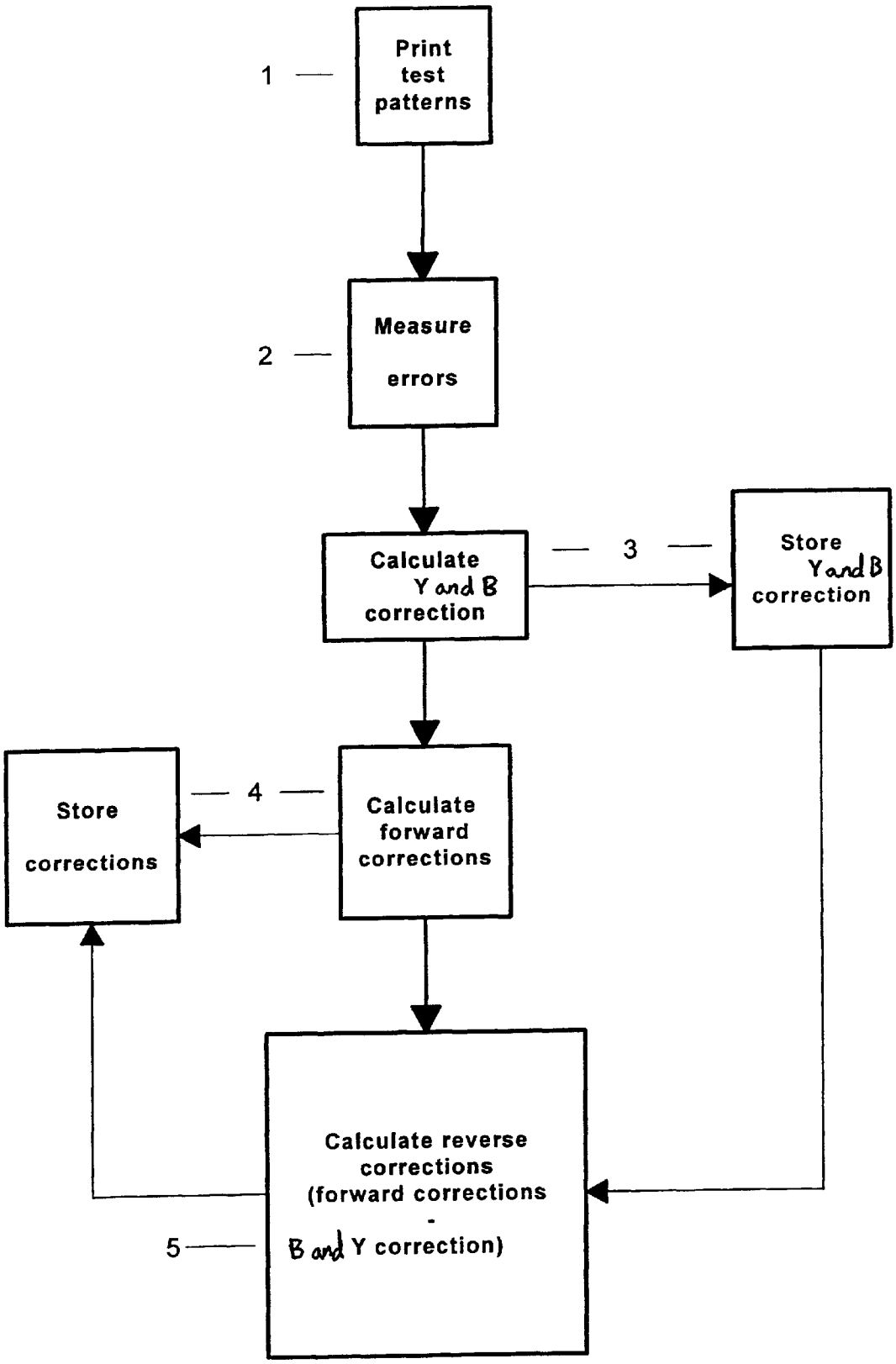
FIG. 15 is a flowchart of a printhead alignment procedure incorporating the correction system of the present invention.

With reference to FIG. 15 representing a schematic flowchart of corrections which can be included in a printhead alignment procedure incorporated into the printer/plotter, referring to the correction of what we have called unidirectional and bidirectional rotation errors and bidirectional translations.

Steps 1, 2 and 3 in this procedure are equivalent to the three steps of the correction method described above Step 4 would summarise the application of a method directed solely to the correction of unidirectional errors, which could include both the correction errors due to rotation about the Z axis described earlier and of errors caused by other misalignments of the nozzles. Due to their unidirectional nature, calculation in one printing direction suffices as indicated and this would be done in the forward direction.

In step 5, the corrections in the reverse direction would be made, subtracting the Y and B error corrections (of a bidirectional nature) from the corrections in the forward direction.

In a similar manner, the correction system of the present invention may be integrated in another corrections performed by printhead alignment procedures incorporated into the printer/plotter.

From the foregoing description it will be readily gathered that by means of embodiments of the present invention, correction can be achieved of the printing errors that appear along the scan axis, whether jointly or in differentiated form for those which, whatever their cause, manifest themselves in effects similar to those we have been identifying as B, Y and Z errors.

The preferred embodiment of the method we have described has, particularly, the advantage that it provides a solution for the correction of said errors that requires the printing of very few test patterns facilitating its integration in printhead alignment procedures for the correction of other errors (which may require the printing and measurement of other test patterns not described herein).

The tests conducted have shown its correct operation and, the preferred method is applicable when the errors produced are to be found within certain limits. Assuming that the mentioned B, Y and Z errors were to be caused solely by rotations of the printhead in relation to the Y and Z axes, and translations of the printhead along the Z axis, it has been verified that the method is applicable for rotation angles up to at least 10 degrees.

What is claimed is:

1. A method, applicable to an inkjet printer having a scanning carriage, capable of bidirectional scanning along a scan axis, in which at least one printhead is mounted, for correcting for drop placement errors due to relative rotation between the printhead and the print media to be printed on, the method comprising the steps of:

first determining the relative contribution to the drop placement error due to rotation of the printhead about the scan axis (Y axis error), then, with respect to any determined Y axis error, applying the same magnitude and sense of correction for drop placement errors while printing in both a first scanning direction of the carriage and while printing in a second scanning direction of the carriage.

2. A method as claimed in claim 1, wherein the determining step comprises determining both the Y axis error and the relative contribution to the drop placement error due to rotation of the printhead about the normal to the plane of the print media (Z axis error), then, with respect to any determined Y axis error, applying the same magnitude and sense of correction for drop placement errors while printing in both the first scanning direction of the carriage and while printing in the second scanning direction of the carriage, and with respect to any determined Z axis error, applying the same magnitude of correction while printing in both the first scanning direction of the carriage and while printing in the second scanning direction of the carriage, but reversing the sense of the correction so that a timing correction advance applied in the first direction becomes a timing correction delay when applied in the second direction and so that a timing correction delay applied in the first direction becomes a timing correction advance when applied in the second direction.

3. A method as claimed in claim 2, wherein in said determining step a composite drop placement error which is due to both Y axis error and Z axis error combined is determined and a drop placement error due to Y axis error alone is determined, and wherein in said applying step a first correction corresponding to the sum of the Y axis error and Z axis error is applied in the first scanning direction and a second correction corresponding to the difference between the Y axis error and Z axis error is applied in the second scanning direction.

4. A method as claimed in claim 3, wherein said first correction is calculated by measuring the sum of the drop placement errors due to Y axis errors and Z axis errors and the second correction is calculated by subtracting twice the measured value of the Y axis error from the first correction.

5. A method as claimed in claim 1 wherein the determining step comprises printing by the printhead a test pattern on print media in which either Y errors or both Y and Z errors manifest themselves and measuring said test pattern to determine said errors.

6. A method as claim 5, wherein said test pattern is measured by a sensor mounted on the carriage of the printer.

7. A method as claimed in claim 5, in which the test pattern consists of a set of a plurality of printed blocks printed by at least two groups of nozzles of the printhead wherein said at least two groups of nozzles are separated from one another along the height of the printhead.

8. A method according to claim 7, wherein a first group of said nozzles is located towards a first end of the printhead and a second group of said nozzles is located at towards a second end of the printhead.

9. A method as claimed in claim 7, wherein each of the said groups of nozzles comprise one nozzle.

10. A method as claimed in claim 5 wherein said test pattern is printed during two passes of the carriage over the print media and wherein the media is not advanced between the two passes of the carriage.

11. A method as claimed in claim 5, wherein a first distance between adjacent blocks printed by the same group of nozzles during a pass in a first scanning direction of the carriage is measured for each of the groups of nozzles and the separation of an intervening block printed by the same group of nozzles during a pass in a second scanning direction of the carriage to the midpoint of said first distance is determined and utilised in determining Y errors.

12. A method as claimed in claim 11, wherein a second distance between blocks printed by different groups of nozzles during two passes of the carriage in the same scanning direction is measured and utilised in determining Z errors.

13. A method as claimed in claim 5, wherein measurements made from said test pattern are utilised to correct for unidirectional and bidirectional printing errors by applying relative delays or advances to the firing time of nozzles of the printhead.

14. A method as claimed in claim 7, wherein a correction parameter is applied to each nozzle of the printhead to correct for said determined errors and wherein correction parameters for nozzles which have not been utilised to print the test pattern are obtained by interpolation of the correction parameters calculated for the groups of nozzles which printed the test pattern.

15. A method according to claim 1 in which the correction parameters are calculated for different carriage scanning speeds.

16. A printhead alignment procedure included in an inkjet printer, using the correction method subject of claim 1 as the sole method for correcting systematic errors in the scan axis.

17. A printhead alignment procedure included in an inkjet printer, using the correction method subject of claim 1 together with other methods for correcting systematic errors in the scan axis.

18. Apparatus for correcting for drop placement errors in an inkjet printer due to relative rotations between the printhead and the print media to be printed on comprising: a processor to store and apply correction parameters for the firing time of nozzles of said printhead wherein said stored correction parameters have been determined in accordance with the method claimed in claim 1.

19. Apparatus as claimed in claim 18, further comprising a test pattern generator for printing a test pattern on print media and a sensor module for obtaining measurements from said printed test pattern and wherein the processor is capable of generating said correction parameters in dependence on the measurements made from said printed test pattern.

20. Apparatus as claimed in claim 18, wherein the processor stores correction parameters for only one printhead of a plurality mounted within the carriage of the printer.

* * * * *